US006082993A

United States Patent [19]

O'Leary et al.

[11] Patent Number: 6,082,993

[45] Date of Patent: Jul. 4, 2000

[54] INDUCED DRAFT HEATER WITH PREMIXING BURNERS

[75] Inventors: Timothy P. O'Leary, Antioch; David L. Schardt, Brentwood; Vance Willis, Nashville, all of Tenn.

[73] Assignee: H-Tech, Inc., Wilmington, Del.

[21] Appl. No.: 09/322,394

[22] Filed: May 28, 1999

[51] Int. Cl.[7] ..... F23N 5/24; F24H 3/00; F23D 14/62; B01F 3/02

[52] U.S. Cl. ..... 431/18; 431/12; 431/354; 431/355; 126/116 R; 126/91 A; 126/116 A; 48/180.1

[58] Field of Search ..... 431/12, 18, 19, 431/20, 354, 355; 126/116 R, 116 A, 91 A; 48/180.1

[56] References Cited

U.S. PATENT DOCUMENTS

| | | | |
|---|---|---|---|
| 1,955,622 | 4/1934 | Dayton . | |
| 2,216,809 | 10/1940 | Derby . | |
| 3,814,576 | 6/1974 | Brockhurst | 431/354 |
| 3,829,279 | 8/1974 | Qualley et al. | 431/354 |
| 4,204,832 | 5/1980 | Miller . | |
| 4,334,855 | 6/1982 | Nelson . | |
| 4,340,355 | 7/1982 | Nelson et al. . | |
| 4,533,315 | 8/1985 | Nelson . | |
| 4,790,268 | 12/1988 | Eising . | |
| 5,112,217 | 5/1992 | Ripka et al. . | |
| 5,244,381 | 9/1993 | Cahlik | 431/171 |
| 5,423,675 | 6/1995 | Kratsch | 431/354 |
| 5,524,556 | 6/1996 | Rowlette et al. . | |
| 5,667,375 | 9/1997 | Sebastiani | 431/12 |
| 5,720,231 | 2/1998 | Rowlette et al. . | |
| 5,762,490 | 6/1998 | Rodgers | 431/354 |
| 5,806,440 | 9/1998 | Rowlette et al. . | |
| 5,873,712 | 2/1999 | Guerra | 431/353 |

*Primary Examiner*—Ira S. Lazarus
*Assistant Examiner*—David Lee
*Attorney, Agent, or Firm*—Selitto & Associates, P.C.

[57] ABSTRACT

A fuel/air mixture control for an induction heater having a tube-type burner includes a side-venting fuel nozzle for introducing fuel into an induction air stream entering the burner. A multi-speed blower draws combustion air into the burner and an air flow constrictor disposed proximate the fuel nozzle increases the velocity of the induction air stream proximate the fuel nozzle, increasing the volume of fuel introduced into the burner conduit. The fuel/air mixture depends upon the speed of the blower, which can be thermostatically controlled to increase speed upon sensing higher temperature combustion products, thereby maintaining a steady mass air flow and air/fuel mixture.

20 Claims, 4 Drawing Sheets

INDUCED DRAFT HEATER WITH PREMIXING BURNERS

FIELD OF THE INVENTION

The present invention relates to induced draft heaters, and more particularly to apparatus and methods for supplying an efficient fuel/air mixture in an induced draft heater.

BACKGROUND OF THE INVENTION

Induced draft heaters are well known and various apparatus has been devised to supply an efficient fuel/air mixture for combustion in such heaters. In addition to promoting fuel efficiency, induction draft heater design objectives also include safety and control of exhaust stack temperatures to permit venting through plastic flue pipe or at or near ground level. For example, U.S. Pat. No. 4,204,832 to Miller discloses a gas burner utilizing an induction fan disposed in the exhaust vent. The fan is controlled thermostatically and is capable of operating at more than one speed. The stated purpose of the thermostatically controlled induction fan is to control the proportion of secondary air entering the heater to control the temperature of the flue gases and the combustion of the fuel gas in the flame 13. As stated in the patent, the primary air and the fuel gas are mixed in a conventional manner.

It is conventional to have an adjustable air aperture at the air inlet proximate to the gas inlet. For example, U.S. Pat. No. 1,955,622 to Dayton shows, inter alia, a control plate that can affect the volume of air entering a conical air mixer to control the air/fuel ratio. U.S. Pat. No. 4,790,268 to Eising discloses an induction type, gas-fired water heater which aspirates air by venturi effect, viz., by a concentric venturi having a large diameter end communicating with the atmosphere and a small diameter end disposed adjacent the outlet of the burner.

The induction fan in an induced draft heater affects both the intake air flow and the exhaust product flow out the flue. Certain patents suggest that a variable speed fan may have utility for various reasons. For example, U.S. Pat. No. 5,524,556, to Rowlette et al. discloses an induced draft gas furnace having an induced draft fan with a variable speed to compensate for changes in back pressure in the vent line. The patent recognizes that the induction fan affects the fuel/air mixture by controlling the air flow into the combustion process. A selected constant flow of air is provided by controlling the speed of the fan motor and the volume of air moved by the induction fan is determined by measuring the fan parameters proportional to motor torque and speed which are read on a continual basis and processed by a microprocessor. The microprocessor responds to input data by controlling the pulse width output and the drive duty cycle for the fan motor.

U.S. Pat. Nos. 4,334,855, 4,340,355 and 4,533,315 to Nelson each disclose a gas fired heater having a two-speed induction blower with high and low speeds, corresponding to a high and low firing rate. In the Nelson patents, the means for accomplishing the adjustment of the fuel/air ratio is a valve which varies the gas supply in response to a pressure differential on either side of a constriction in the exhaust vent.

U.S. Pat. No. 5,112,217 to Ripka et al. discloses a gas fired heater with a constant fuel flow rate and a variable air flow rate established by a variable speed induction fan. The induction fan speed is determined by sensing upon and digitizing the radiation generated by the burner which is compared by a computer to a reference measure of radiation.

The computer adjusts the fan speed to increase or decrease the air flow such that the sensed radiation comes to approximate the desired standard radiation. The radiation sensed is described in the specification as in the upper ultra violet, visible or near infrared ranges and is transmitted from the interior of the burner to the exterior by means of a fiber optic cable. A radiation source is provided, e.g., a light emitting diode, which serves as the standard to which the flame radiation is compared. Accordingly, the burner includes a calibration methodology and apparatus that accommodates the changed operating parameters associated with sensor age and the degradation of the sensor.

Notwithstanding the various apparatus that have been proposed in the field, there remains a need for an induced draft heater having an air/fuel mixture control that is both efficient and simple. Accordingly, it is therefore an object of the present invention to provide an air/fuel mixture control having those qualities.

SUMMARY OF THE INVENTION

The problems and disadvantages associated with the conventional techniques and devices utilized for controlling the fuel/air proportions in an induced draft furnace having a burner conduit with a plurality of outlet apertures for emitting a mixture of fuel and air to be burned and an inlet aperture for admitting air are overcome by the present invention which includes a side-venting fuel nozzle for injecting fuel into the burner conduit. The fuel nozzle has an outlet orifice from which fuel is discharged. A blower draws air into the inlet aperture of the burner and an air flow constrictor disposed proximate the inlet aperture increases the velocity of the inlet air proximate the outlet orifice of the fuel nozzle, increasing the volume of fuel injected into the burner conduit.

BRIEF DESCRIPTION OF THE SEVERAL VIEWS OF THE DRAWINGS

For a better understanding of the present invention, reference is made to the following detailed description of an exemplary embodiment considered in conjunction with the accompanying drawings, in which.

DETAILED DESCRIPTION OF THE INVENTION

Figure 1:
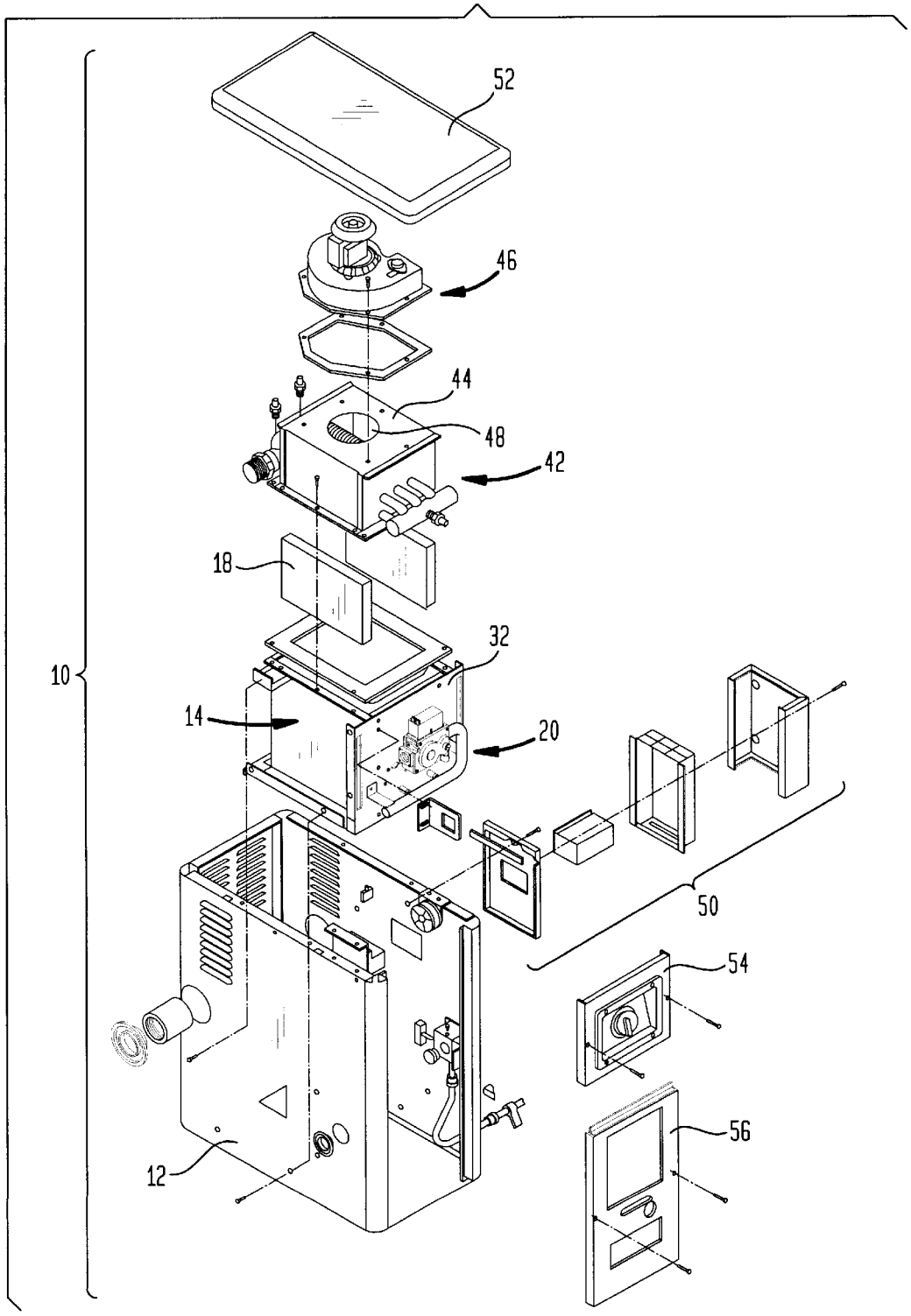
FIG. 1 is an exploded, perspective view of a heater in accordance with an exemplary embodiment of the present invention.
Figure 2:
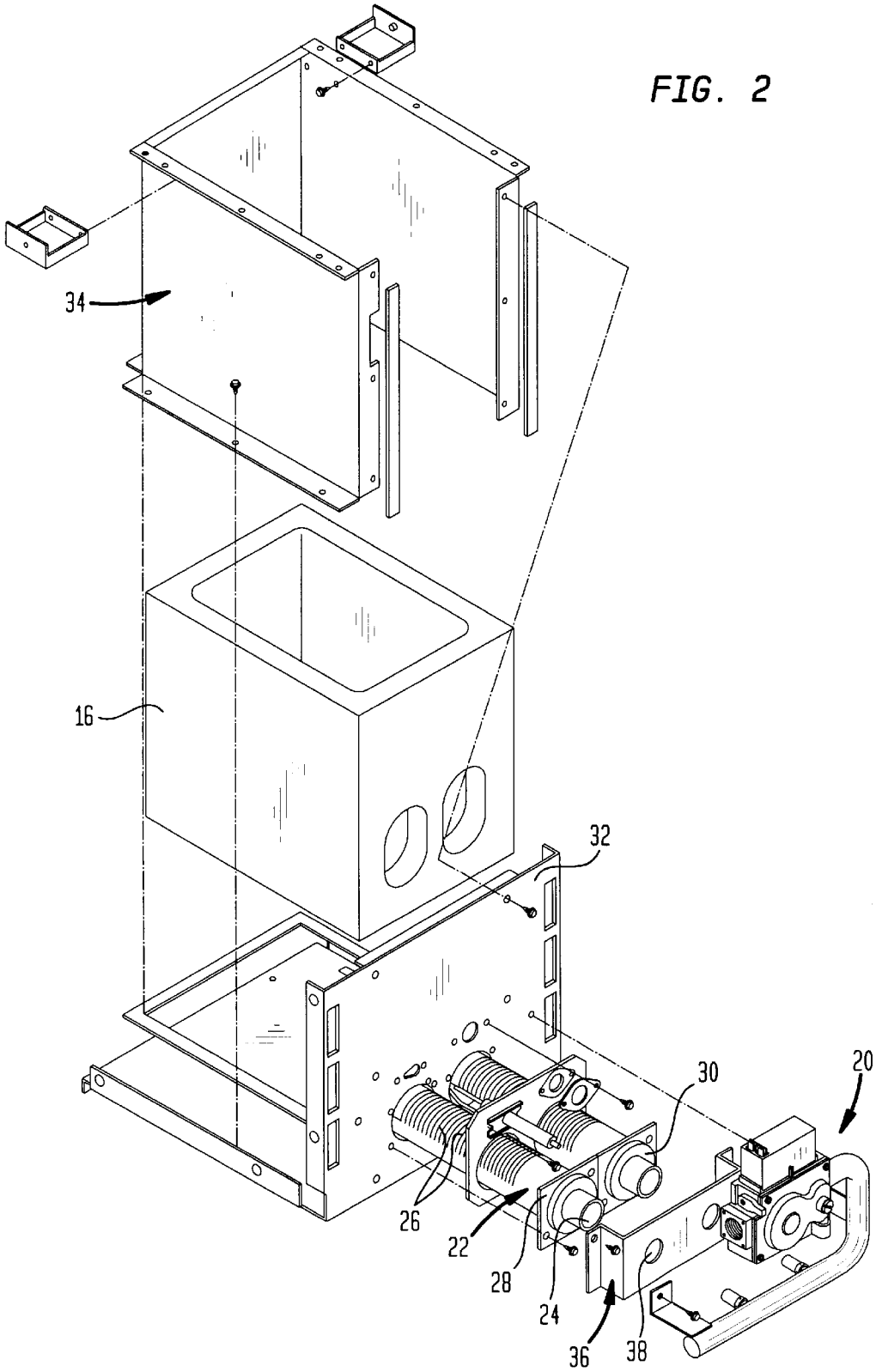
FIG. 2 is an enlarged, exploded view of the combustion chamber and fuel supply assemblies of the heater of FIG. 1.

FIGS. 1 and 2 show an induced draft heater 10 in accordance with the present invention. The cabinet 12 houses a combustion chamber assembly 14 which may include a unitized refractory chamber 16 and/or be composed of a plurality of refractory panels 18. A fuel supply/burner assembly 20 is positioned proximate to the combustion chamber assembly 14 with burner tubes 22 extending therein. The burner tubes 22 have an inlet aperture 24 and a plurality of flame apertures 26 disposed along an upper surface thereof. The burner tubes 22 are attached to a mounting flange 28 with the juncture therebetween stiffened by an optional tube support 30. The mounting flange 28 is secured to a burner support panel 32 which attaches to the combustion chamber casing 34 and holds the burner tubes 22 in the proper position extending into the refractory chamber 16.

An air orifice bracket 36 having air orifices 38 spaced on center at the same center-to-center spacing as the burner tubes 22 is affixed either to the burner support panel 32 or the mounting flange 28 such that the air orifices 38 are held in approximately concentric relationship to the inlet apertures 24 of the burner tubes 22. The fuel supply assembly 20 is secured to the burner support panel 32 with the fuel nozzles 40 thereof approximately concentrically disposed with respect to the air orifices 38 and inlet apertures 24.

A heat exchanger assembly 42 has a housing 44 which defines a plenum for conducting combustion products from the combustion chamber assembly 14 across a plurality of heat exchanger tubes serving as a conduit for the fluid to be heated, e.g., water or air, in a conventional fashion. A blower 46 is positioned on top of the housing 44 over an outlet opening 48 therein and draws combustion products from the combustion chamber assembly 14 through the heat exchanger assembly 42 and vents the exhaust out the flue assembly 50. In the embodiment shown, the heater 10 is side venting and the top cover 52 is a solid panel. A control panel 54 and access door 56 are provided in a conventional manner.

Figure 3:
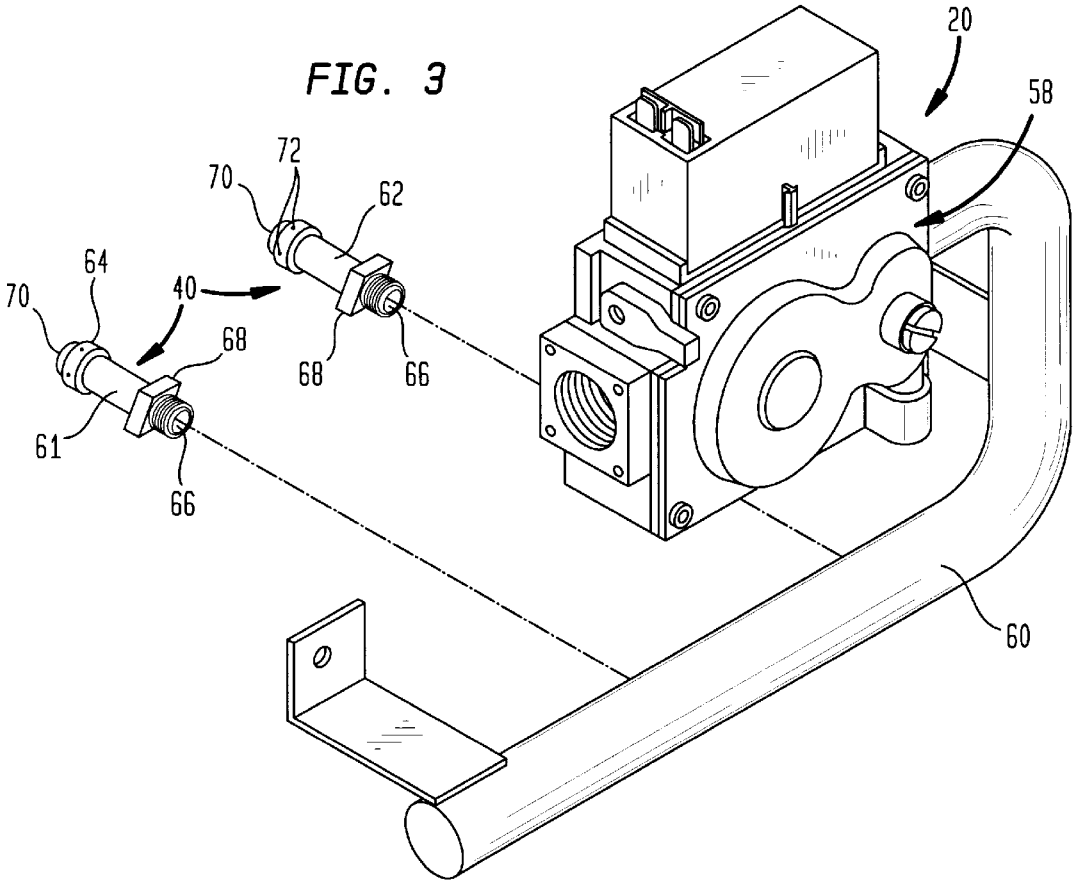
FIG. 3 is an enlarged, exploded view of the fuel supply assembly of the heater of FIG. 1.

FIG. 3 shows the fuel supply assembly 20 having a conventional gas valve 58 for controlling the release of gas into a gas manifold 60, into which are installed the fuel nozzles 40. The fuel nozzles are preferably provided with an elongated shaft 62 and a peripheral land 64. The nozzles 40 may be threaded at the inlet end 66 and have a wrench engaging surface 68 to facilitate threading the nozzles 40 into the manifold 60. The nozzles 40 have a blind end 70 opposite to the inlet end 66 with a plurality of radial fuel outlet orifices 72 venting through the side of the nozzle 40 in the area of the land 64.

Figure 4:
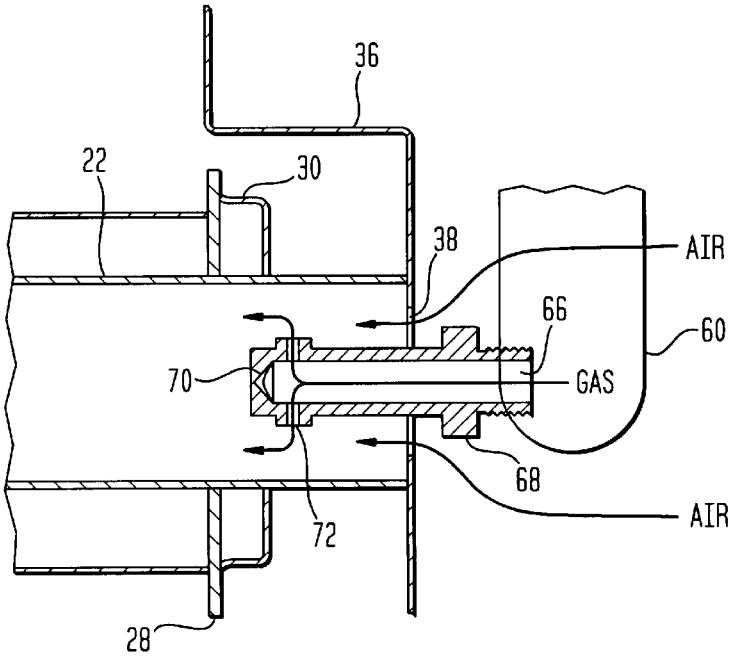
FIG. 4 is a cross-sectional view of a fuel nozzle and associated burner tube and air orifice bracket of the heater of FIG. 2, taken along section line IV—IV and looking in the direction of the arrows.

FIG. 4 shows the spacial relationship between the nozzle 40, the burner tube 22 and air orifice bracket 36. The radius of the air orifice 38 is smaller than the radius of the inside lumen of the burner tube 22. When a flow of air into the burner tube 22 is induced by the blower 46, the inwardly extending constriction in air flow caused by the air orifice gives rise to an increase in air velocity proximate to the constriction and the nozzle 40. The increase in velocity in accordance with the Bernoulli Principle leads to a drop in pressure. The drop in pressure proximate to the fuel outlet orifices 72 leads to an increase in fuel flow from the orifices 72, since the flow depends upon the difference between the gas pressure inside the nozzle compared to the external air pressure. The lower the exterior air pressure relative to the internal gas pressure, the greater the flow of fuel from the outlet orifices 72.

Figure 5:
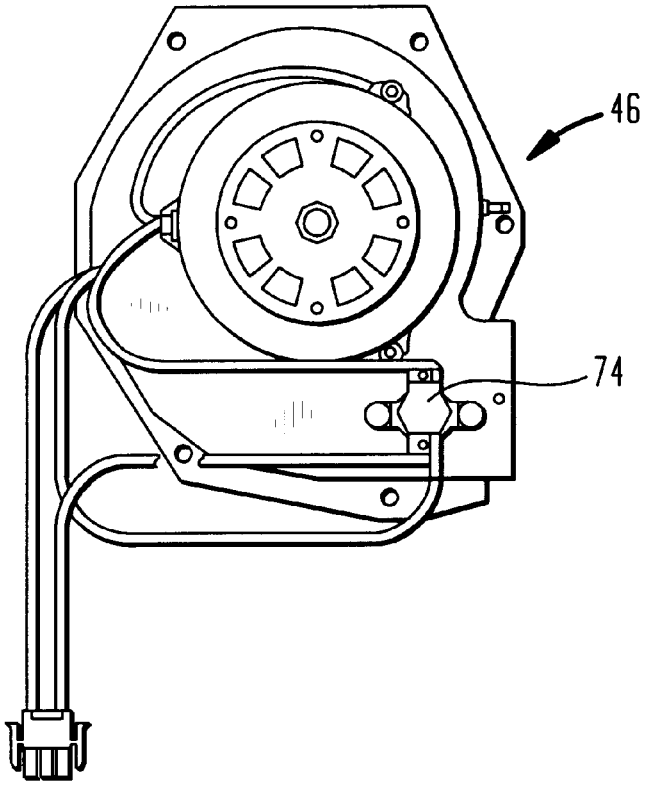
FIG. 5 is a top view of a blower of the heater of FIG. 1.
Figure 6:
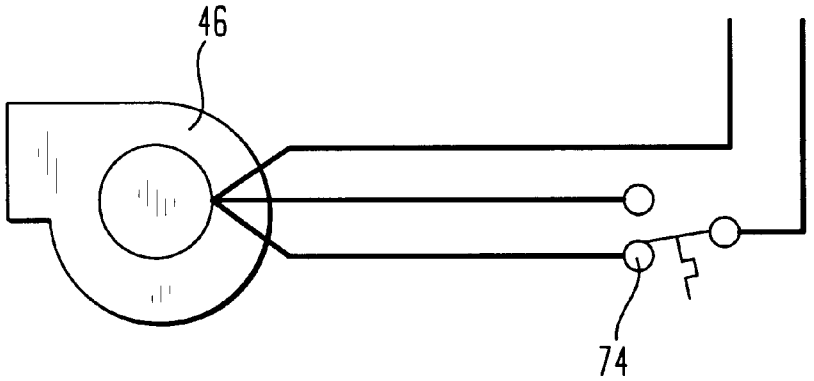
FIG. 6 is a schematic depiction of the blower/switch circuitry of the heater of FIG. 1.

FIGS. 5 and 6 show a blower 46 in accordance with the present invention. The blower 46 is capable of running at two or more different speeds as controlled by a temperature switch 74. The temperature switch 74 shown is a single-pole-double-throw switch which is mounted on the blower outlet. The switch 74 is wired so that it deactuates the blower's low speed and actuates the blower's high speed when the switch itself is actuated.

For proper operation, a combustion system with a single fuel gas input and with premixing burners requires the fuel gas to combustion air ratio to be held nearly constant. In an induced-draft combustion system, the combustion blower moves combustion air before ignition and flue products after ignition. After ignition, the temperature of the flue products progressively rises until it reaches a steady-state temperature. Since a blower is a constant volume device, it moves the same volumetric flow no matter what the density is. The density of the ambient air is substantially greater than the density of the steady-state flue products, and the density of the flue products decreases further as the flue products' temperature increases. Therefore, the mass flow that the blower moves is greater before ignition, and progressively decreases after ignition until the temperature of the flue products reaches steady-state. As a result, the fuel gas and air mixture starts out lean, and after ignition it becomes progressively richer until equilibrium is reached. Because of this effect, an induced-draft combustion system with premixing burners requires mechanisms to maintain a nearly constant fuel gas to combustion air ratio from ignition to steady-state operation.

The combustion system of the present invention consists of two mechanisms to control the fuel to air ratio. The first mechanism maintains the same air mass flow at ignition and at steady-state operation. This mechanism consists of the two-speed blower 46 along with the temperature switch 74 mounted at the blower outlet. The lower speed on the blower is designed such that it moves the same mass flow of ambient air as the 20 higher speed moves of flue products. During ignition, the combustion blower 46 runs at low speed. As the temperature of the flue products progressively increases, the temperature switch switches the blower speed from low to high when the flue products approach their steady-state value.

The second aspect of the present invention which controls the fuel/air ratio is the air orifice bracket 36 and gas injector 40 combination. The air orifice 38 of the bracket 36 produces a pressure-drop when combustion air flows into the burners 22. The pressure-drop across the orifice 38 is less when the air mass flow is less. The fuel gas is injected into the air stream after the air orifice 38 in order to prevent an influence from velocity pressures. To prevent an influence from velocity pressures, the fuel gas is injected normal to the combustion airflow direction. The flow rate of fuel gas into the combustion system depends on the pressure drop across the gas injector and the pressure drop across the gas injector is the sum of the positive gas manifold pressure plus the negative pressure just past the air orifice 38. Because the pressure drop across the gas injector decreases as the air mass flow decreases, the fuel flow decreases as air mass flow decreases. This decrease in fuel gas flow alleviates an increase in the fuel-air ratio caused by a decrease in the mass flow moved by the combustion blower attributable to the decrease in density of the heat flue gases. Each of these two mechanisms allow the system to approximate a constant fuel-air relationship from ignition to steady-state operation.

It should be understood that the embodiments described herein are merely exemplary and that a person skilled in the art may make many variations and modifications without departing from the spirit and scope of the invention as defined in the appended claims.

What is claimed is:

1. A fuel/air mixture control system for a draft induction furnace having a burner conduit equipped with a plurality of outlet apertures for emitting a mixture of fuel and air to be burned and an inlet aperture for admitting air, comprising:

a fuel nozzle for injecting fuel into the burner conduit, said fuel nozzle having an elongated portion with a substantially cylindrical shape and a fuel inlet at one end, said fuel inlet communicating with an internal lumen in said elongated portion, said lumen being blind at an end of said nozzle distal to said fuel inlet, said elongated portion having a peripheral land disposed thereabout proximate said blind end, said land having an outer surface which is substantially cylindrical and which is positioned substantially coaxially relative to said elongated portion, said outer surface of said land having a diameter which is larger than that of said elongated portion and having at least one fuel outlet orifice therein communicating with said lumen and positioned to discharge fuel at an angle having a component perpendicular to a longitudinal axis of said nozzle;

a blower for drawing air into the inlet aperture of the burner conduit; and an air flow constrictor proximate the inlet aperture of the burner conduit, said constrictor increasing the velocity of said inlet air proximate said outlet orifice of said fuel nozzle and increasing the volume of fuel injected into the burner conduit.

2. The control system of claim 1, wherein said outlet orifice of said fuel nozzle discharges at an angle having a component perpendicular to air flow direction in the burner conduit.

3. The control system of claim 2, wherein said angle is substantially 90 degrees relative to said air flow direction.

4. The control system of claim 3, wherein said fuel nozzle has a plurality of outlet orifices.

5. The control system of claim 2, wherein said constrictor is an apertured plate having an air flow aperture smaller in cross-sectional area than the inlet aperture of the burner conduit, said air flow aperture being positioned approximately on center with the inlet aperture such that a substantial portion of air entering the inlet aperture passes through said air flow aperture before entering the inlet aperture.

6. The control system of claim 4, wherein said outlet orifices are at least four in number.

7. The control system of claim 1, wherein said blower operates at more than one speed, with said blower speed being controlled by a temperature sensitive switch.

8. The control system of claim 7, wherein said temperature sensitive switch is positioned in the exhaust stream of the furnace to sense on exhaust gas temperatures, said switch inducing the blower to increase speed upon sensing increased temperatures, thereby tending to maintain a prescribed inlet flow by increasing the volume of gas moved by said blower to compensate for less dense heated exhaust gases.

9. The control system of claim 8, wherein said outlet orifice of said fuel nozzle discharges at an angle having a component perpendicular to air flow direction in the burner conduit and wherein said constrictor is an apertured plate having an air flow aperture smaller in cross-sectional area than the inlet aperture of the burner conduit, said air flow aperture being positioned approximately on center with the inlet aperture such that a substantial portion of air entering the inlet aperture passes through said air flow aperture before entering the inlet aperture.

10. A draft induction furnace, comprising:

a burner assembly for burning hydrocarbon fuel;

a combustion chamber, said burner assembly extending at least partially into said combustion chamber;

a heat exchanger having a conduit for conducting a fluid to be heated disposed proximate to said combustion chamber such that heat generated by said burner assembly contacts said heat exchanger and heats the fluid to be heated;

a variable speed vent blower for drawing combustion products from said combustion chamber, over said heat exchanger, through said vent blower and out an exhaust vent, said vent blower drawing air for combustion into said burner assembly, the quantity of air drawn by said blower depending upon the speed of said blower, said burner assembly including a fuel nozzle, said fuel nozzle having an elongated portion with a substantially cylindrical shape and a fuel inlet at one end, said fuel inlet communicating with an internal lumen in said elongated portion, said lumen being blind at an end of said nozzle distal to said fuel inlet, said elongated portion having a peripheral land disposed thereabout proximate said blind end, said land having an outer surface which is substantially cylindrical and which is positioned substantially coaxially relative to said elongated portion, said outer surface of said land having a diameter which is larger than that of said elongated portion and having at least one fuel outlet orifice therein communicating with said lumen and positioned to discharge fuel at an angle having a component perpendicular to a longitudinal axis of said nozzle, said at least one outlet orifice and said outer surface and said land being exposed to air drawn by said blower, the quantity of fuel entering said burner assembly depending upon the velocity of air drawn by said blower, with greater fuel flow achieved by greater blower speed.

11. The furnace of claim 10, wherein said burner assembly includes an air flow restrictor positioned proximate to said outlet orifice, said air flow restrictor diminishing the cross-sectional area through which said drawn air flows, increasing the velocity of said drawn air and decreasing the pressure of said drawn air, whereby the amount of fuel exiting said outlet orifice increases.

12. The furnace of claim 11, wherein said blower speed is determined by a temperature sensor sensing upon the temperature of said combustion products, said blower speed being increased with an increase in temperature to compensate for lower density and to thereby maintain approximately the same mass air flow past said outlet orifice.

13. The furnace of claim 12, wherein said blower has two speeds and said air velocity responsive fuel feed from said outlet orifice maintains a stable fuel/air mixture during start-up of said heater and after said heater has reached a steady elevated temperature by running said blower at a first, lower speed and then at a second, higher speed.

14. A fuel/air mixture control system for an induction heater having a tube-type burner, comprising:

a fuel nozzle for introducing fuel into an induction air stream entering said burner, said fuel nozzle having an elongated portion with a substantially cylindrical shape and a fuel inlet at one end, said fuel inlet communicating with an internal lumen in said elongated portion, said lumen being blind at an end of said nozzle distal to said fuel inlet, said elongated portion having a peripheral land disposed thereabout proximate said blind end, said land having an outer surface which is substantially cylindrical and which is positioned substantially coaxially relative to said elongated portion, said outer surface of said land having a diameter which is larger than that of said elongated portion and having at least one fuel outlet orifice therein communicating with said lumen and positioned to discharge fuel at an angle having a component perpendicular to a longitudinal axis of said nozzle;

a multi-speed blower for drawing combustion air into said burner; and an air flow constrictor disposed proximate said fuel nozzle, said constrictor increasing the velocity of said induction air stream proximate said fuel nozzle and increasing the volume of fuel introduced into said burner conduit, said fuel/air mixture being dependant upon the speed of said blower.

15. The mixture control system of claim 14, wherein said blower speed is dependent upon the temperature of combustion by-products produced by said burner, with greater temperatures causing said blower to run at a higher speed.

16. The mixture control system of claim 15, wherein said fuel nozzle has a plurality of fuel vents, each disposed perpendicularly to said induced air stream.

17. A fuel/air mixture control system for a draft induction furnace having a burner conduit equipped with a plurality of outlet apertures for emitting a mixture of fuel and air to be burned and an inlet aperture for admitting air, comprising:

a fuel nozzle for injecting fuel into the burner conduit, said fuel nozzle having an outlet orifice from which fuel is discharged;

a blower for drawing air into the inlet aperture of the burner conduit; and an air flow constrictor proximate the inlet aperture of the burner conduit, said constrictor increasing the velocity of said inlet air proximate said outlet orifice of said fuel nozzle and increasing the volume of fuel injected into the burner conduit, said outlet orifice of said fuel nozzle discharging at an angle having a component perpendicular to air flow direction in the burner conduit, said constrictor including an apertured plate having an air flow aperture smaller in cross-sectional area than the inlet aperture of the burner conduit, said air flow aperture being positioned approximately on center with the inlet aperture such that a substantial portion of air entering the inlet aperture passes through said air flow aperture before entering the inlet aperture.

18. The control system of claim 17, wherein the burner conduit is substantially cylindrical and said air flow aperture is substantially circular and disposed substantially concentrically relative to the inlet aperture.

19. The control system of claim 18, wherein said fuel nozzle is positioned substantially centrally with respect to said air flow aperture.

20. A fuel/air mixture control system for a draft induction furnace having a burner conduit equipped with a plurality of outlet apertures for emitting a mixture of fuel and air to be burned and an inlet aperture for admitting air, comprising:

a fuel nozzle for injecting fuel into the burner conduit, said fuel nozzle having an outlet orifice from which fuel is discharged, said outlet orifice of said fuel nozzle discharging at an angle having a component perpendicular to air flow direction in the burner conduit, a blower for drawing air into the inlet aperture of the burner conduit, said blower operating at more than one speed, with said blower speed being controlled by a temperature sensitive switch, said temperature sensitive switch being positioned in the exhaust stream of the furnace to sense on exhaust gas temperatures, said switch inducing the blower to increase speed upon sensing increased temperatures, thereby tending to maintain a prescribed inlet flow by increasing the volume of gas moved by said blower to compensate for less dense heated exhaust gases, and an air flow constrictor proximate the inlet aperture of the burner conduit, said constrictor increasing the velocity of inlet air proximate said outlet orifice of said fuel nozzle and increasing the volume of fuel injected into the burner conduit, said constrictor including an apertured plate having an air flow aperture smaller in cross-sectional area than the inlet aperture of the burner conduit, said air flow aperture being positioned approximately on center with the inlet aperture such that a substantial portion of air entering the inlet aperture passes through said air flow aperture before entering the inlet aperture.

* * * * *

UNITED STATES PATENT AND TRADEMARK OFFICE

CERTIFICATE OF CORRECTION

PATENT NO. : 6,082,993
DATED : July 4, 2000
INVENTOR(S) : Timothy P. O'Leary et al.

It is certified that error appears in the above-identified patent and that said Letters Patent is hereby corrected as shown below:

Column 4,
Line 30, delete "20".

Signed and Sealed this

Twenty-first Day of October, 2003

JAMES E. ROGAN
*Director of the United States Patent and Trademark Office*